United States Patent [19]

Vignal et al.

[11] 3,965,694

[45] June 29, 1976

[54] METHOD AND DEVICE FOR THERMALLY AIR-CONDITIONING A ROOM, A VAT OR THE LIKE

[76] Inventors: Maurice Vignal, Faubourg Constant; Henri Chapuis, Boulevard de Vinols, both of Craponne-sur-Arzon (Haute-Loire), France

[22] Filed: June 12, 1974

[21] Appl. No.: 478,495

[30] Foreign Application Priority Data

July 4, 1973 France ..... 73.25143
Mar. 28, 1974 France ..... 74.11887

[52] U.S. Cl. ..... 62/260; 62/335
[51] Int. Cl.[2] ..... F25D 23/12
[58] Field of Search ..... 62/260, 335, 324, 510, 62/151

[56] References Cited

UNITED STATES PATENTS

| | | | |
|---|---|---|---|
| 2,461,449 | 2/1949 | Smith | 62/260 |
| 2,484,371 | 10/1949 | Bayston | 62/260 |
| 2,503,456 | 4/1950 | Smith | 62/260 |
| 2,513,373 | 7/1950 | Sporn | 62/260 |
| 3,267,689 | 8/1966 | Liebert | 62/335 |
| 3,392,541 | 7/1968 | Nussbaum | 62/335 |

FOREIGN PATENTS OR APPLICATIONS

| | | | |
|---|---|---|---|
| 713,582 | 8/1931 | France | 62/260 |

*Primary Examiner*—Lloyd L. King
*Attorney, Agent, or Firm*—Sughrue, Rothwell, Mion, Zinn & Macpeak

[57] ABSTRACT

The present invention is directed toward an air conditioning system having the capability of being utilized as both a heating or cooling system. At least one heat pump is provided to pump heat from a heat source to the air conditioning system to prevent freezing of the system. The heat pump also removes heat from the system, when it is used as a cooling system, and diffuses it into the earth. The earth may also be utilized as a source of heat to be supplied to the system.

7 Claims, 6 Drawing Figures

METHOD AND DEVICE FOR THERMALLY AIR-CONDITIONING A ROOM, A VAT OR THE LIKE

The present invention relates to a new method intended for ensuring the thermal air conditioning (heating or cooling) of premises, vats, and, in particular, dwelling houses.

Electric heating systems are known, which include resistors supplied with electric current. Such systems have drawbacks, in that they consume a very large amount of electric power, so that the working costs soon become unduly high. Moreover, such systems are only able to heat, that is, they cannot act as coolers.

Air conditioning apparatus are known, which include a compressor, the latter delivering a fluid to a closed circuit connected to a condenser. Said apparatus have a heating or cooling power which is comparatively low with respect to the electric power they consume. Moreover, the fact that the refrigerating section ices up affects the performance of the plant adversely.

On the other hand, it is known that at present the de-icing of the evaporator of a refrigerating circuit for a cold room is generally performed by means of an electric resistor disposed along the evaporator. When ice appears on the evaporator, said resistor is supplied with electric current so as to warm up the evaporator to melt the ice.

Said de-icing method has drawbacks, in that it consists actually in introducing calories into the cold room, which calories must be withdrawn therfrom later on.

The object of the present invention is to obviate such drawbacks by providing a reversible air conditioning device (heating or cooling) fitted with de-icing means which prevent introducing additional calories into the cold room, while the electric current consumption of the whole device is kept very low.

The air conditioning method according to the invention is characterized in that it uses at least one heat pump which works between a hot source and a cold source, one of said sources being the atmosphere of the premises, vat, or the like to be air conditioned, while the other source is constituted by the earth's crust in which a part of the circuit for the fluid of the heat pump is buried.

In fact, it is found that the temperature remains substantially constant at the bottom of a hole a few meter deep bored in the ground. Such temperature may, for instance, remain equal to 10°C, summer and winter alike, at the bottom of a hole ten meter deep.

According to a first aspect of the invention, the method is used for heating premises, in which case the heat pump extracts heat from the interior of the earth, and diffuses it in the premises to be heated.

According to another aspect of the invention, the method is used for cooling the premises, in which case the heat pump lowers the temperature of the atmosphere of the premises and delivers heat into the earth, inside the hole.

The air-conditioning apparatus according to the invention is characterized in that it includes a heat pump which works between the atmosphere of the premises or vat to be air-conditioned and the inside of a hole bored in the ground, said heat pump being constituted by the following members disposed along a closed circuit inside which a fluid in the liquid state or the gaseous state circulates:

- a compressor, which receives the cold gaseous fluid and delivers it as a hot gaseous fluid;
- an exchanger into which and from which the fluid flows at different temperatures, said exchanger being thermally steeped in the atmosphere prevailing in the premises to be air-conditioned;
- a capillary tubulure, wherein the fluid circulates to pass from its liquid state to its gaseous state, or conversely;
- a pipe housed inside a deep hole bored in the earth, and inside which the fluid circulates between its temperature of admission and a temperature of delivery substantially equal to the temperature prevailing in the hole.

The hole may, fo instance, be bored in the earth with a diameter of about ten centimeters, and a depth ranging from 10 to 15 meters.

According to another feature of the invention, the device operates as a heating system and:

- the compressor delivers hot gas towards the condenser;
- said gas enters the exchanger-condenser as a hot gas (for instance, from 40° to 80°C), and comes out as a cold gas (for instance, from 20° to 30°C);
- when coming out of the condenser, the gas flows through the capillary tubulure, from which it comes out in the liquid state, at a temperature of, for instance, −20°C;
- the liquid enters the pipe of larger diameter which is buried in the earth; it is first gasified, and then comes out of the earth at a substantially constant temperature (for instance, 8°–10°C) before being sent back to the entry side of the compressor.

According to another feature of the invention, the device operates as a refrigerating system, and:

- the compressor delivers hot gas (from 50° to 80°C) into the tubulure buried in the earth;
- the gas cools down in the earth, then expands, and is liquified at about −20°C before flowing out of the hole;
- the liquid evaporates and warms up in a capillary tubulure, so as to reach the exchanger at a temperature of about 10°C;
- the liquid flows through the exchanger wherein it warms up, then leaves the exchanger and is directed to the entry side of the compressor.

Of course, passing from the heating system to the refrigerating system can take place merely through the operation of a reversing valve mounted between the circuit and the inlet and outlet ports of the compressor.

When the device is a heating device, the pipe buried in the earth is prevented from icing up by disposing in the same hole the heating elements of other heat pumps operating with other bores;

When the device is a refrigerating device for a cold room, the de-icing system of the main evaporator disposed in the cold room is constituted by an auxiliary refrigerating circuit including a condenser and an evaporator housed in the cold room, together with a compressor, the condenser being disposed in said cold room so as to warm up the main evaporator.

The accompanying drawing which is given by way of non-limiting example, will allow understanding the features of the invention more clearly.

Figure 1:
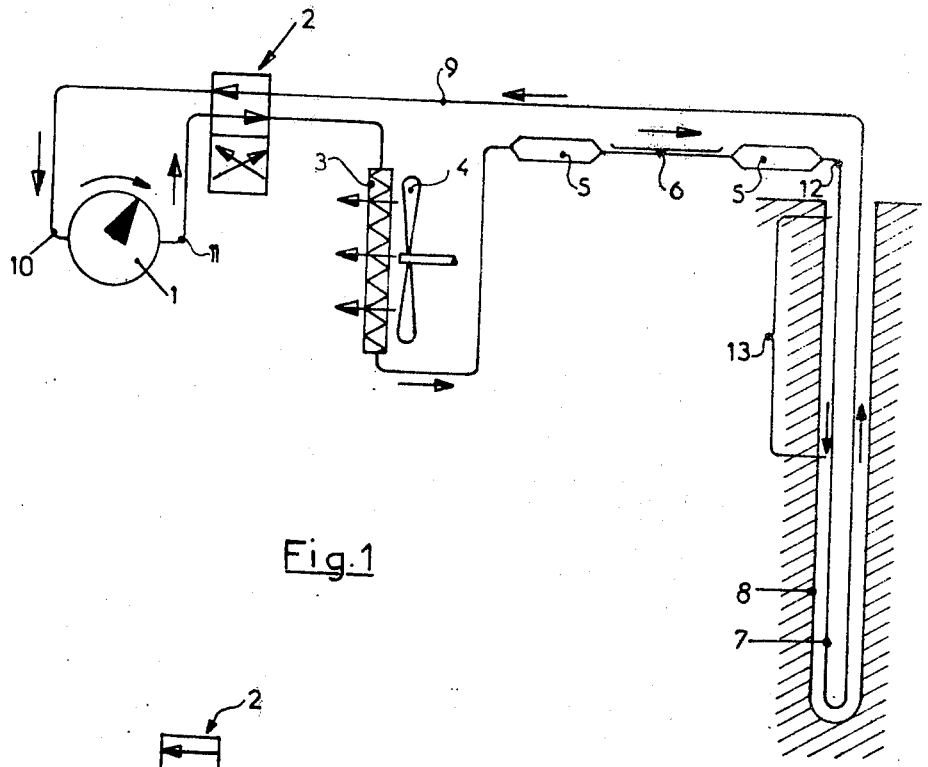
FIG. 1 is a diagrammatic view of a heating system according to the invention.

The device illustrated in FIG. 1 constitutes a closed circuit inside which a fluid such as Freon circulates. Said fluid is adapted to be in its liquid state in certain sections of the circuit, and in its gaseous state in other sections.

The circuit includes:

a compressor 1, driven by an electric motor;

a reversing valve 2;

a condenser 3, in the shape of a radiator through which a fan 4 allows blowing the air of the surrounding premises;

two dehydration cartridges 5, containing, for instance, silica gel, and disposed one at each end of a capillary tubulure 6, the latter being comparatively long and having a small inner diameter;

a pipe 7 with a comparatively large inner diameter, and dipped into a hole 8 bored in the earth;

a return line 9 to the valve 2.

The operation is as follows:

The fluid is sucked at 10 in its gaseous state by the compressor 1, the temperature of the fluid being there of, for instance, about 10°C.

At 11 the compressor 1 delivers a gas, the temperature of which ranges from about 40° to 80°C. Said gas circulates through the condenser 3, wherein it cools down to about 20° or 30°C. The fan 4 blows thus an air which is warm enough to warm the premises.

The gaseous fluid flows through the dehydration cartridge 5, and then is liquified while flowing through the capillary tubulure 6, so that at 12 a liquid circulates, which is at a temperature of about −20°C.

While circulating through the pipe 7, said liquid warms up. It becomes gasified in the area 13. Then, it warms up to the constant temperature which is prevailing in the earth at the bottom of the hole 8. Thus, the gas which comes out of the bore to be sent back to the entry side 10 of the compressor is at a temperature of about 10°C.

It will be seen that the system works as a "heat pump" which takes heat from the earth (hole 8) and supplies it to the air of the premises (force fan 4).

Figure 2:
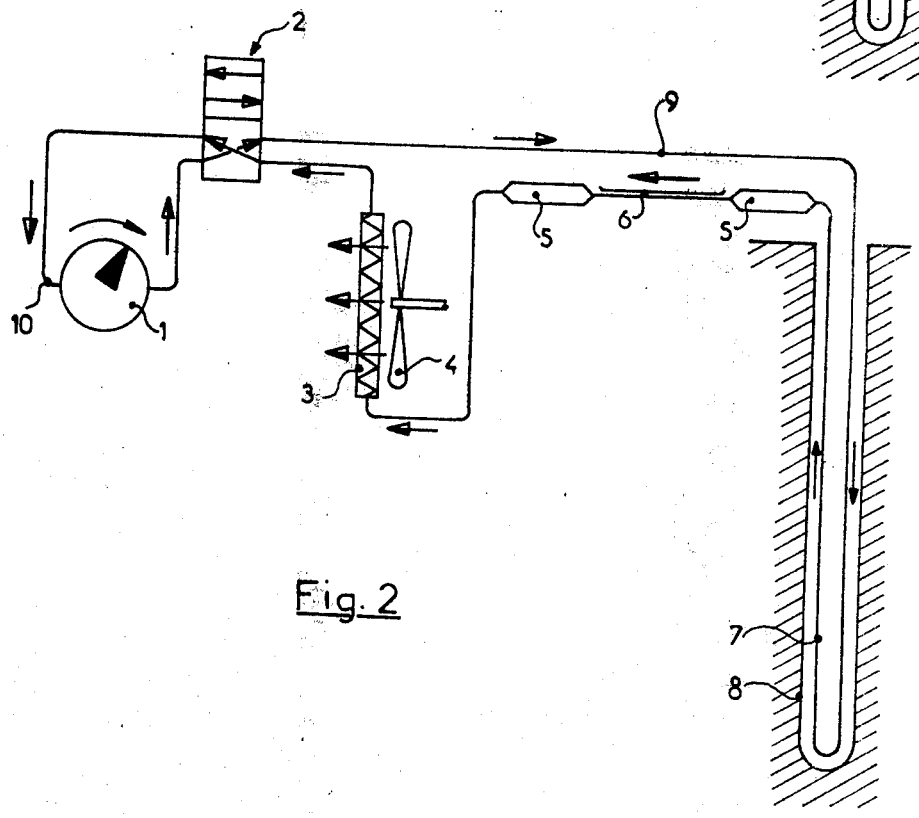
FIG. 2 shows said system operating as a refrigerating system.

It is only necessary to reverse the position of the valve 2 to make the system work as a refrigerating system (FIG. 2), in which case the fan 4 blows cold air, while the gas circulating in the pipe 7 tends to warm up the earth in the hole 8.

The direction of the circulating fluid is reversed, that is, the compressor 1 delivers then into the line 9, while the exchanger 3 is directly connected to the inlet 10 of the compressor 1.

Figure 3:
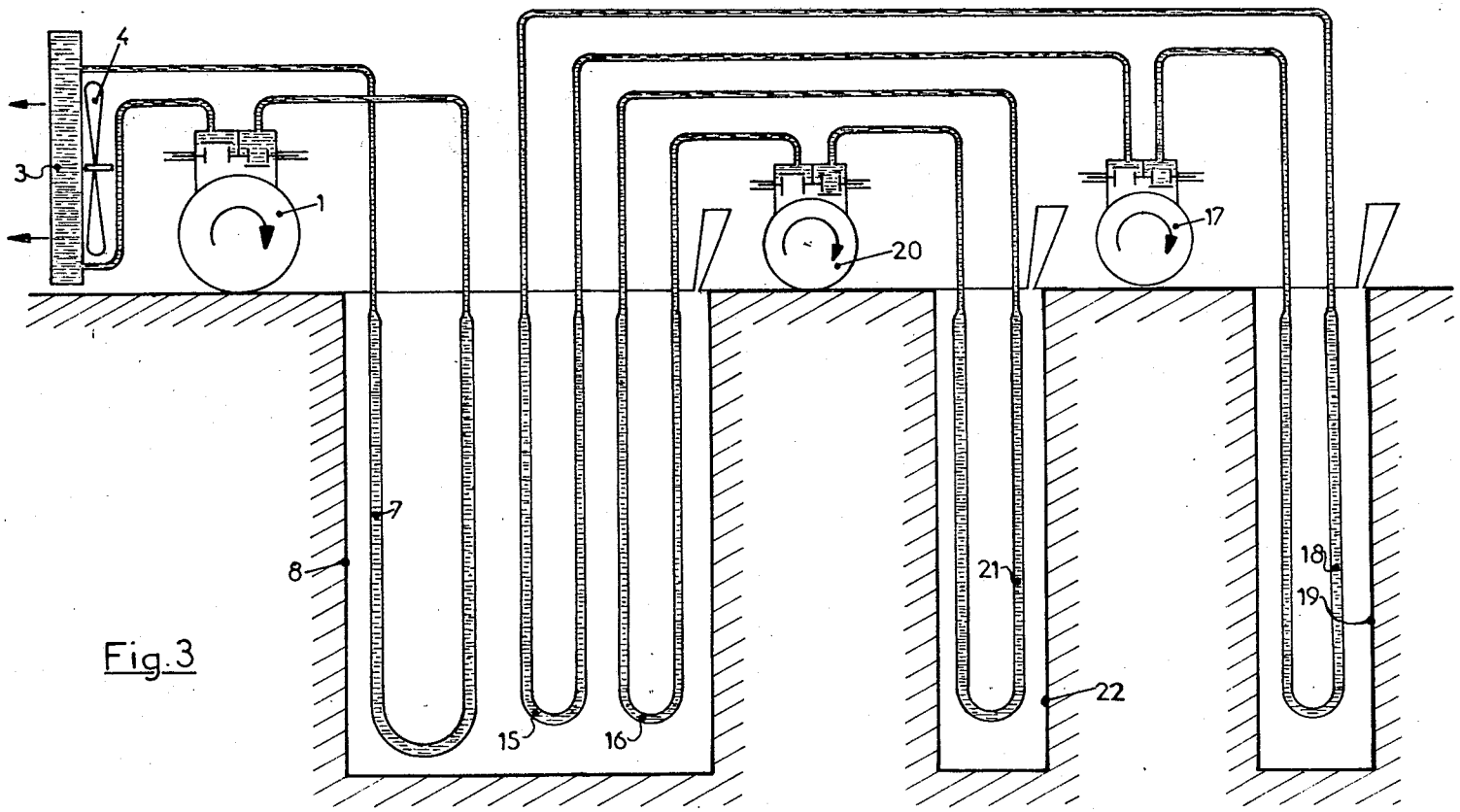
FIG. 3 shows a modified embodiment, wherein the heating system is provided with a de-icing system operating by virtue of the ground action.

When the apparatus works as a heating system (FIG. 1), there is a risk of the walls of the pipe 7 in the hole 8 icing up. To prevent such a risk, and as shown on the modified embodiment of FIG. 3, two other U-shaped tubulures are disposed in said hole 8. Said tubulures 15, 16 act as heaters.

The line 15 is connected, in a closed circuit, to a compressor 17 and to another U-shaped line 18, the latter being buried in another hole 19 in the earth. The line 16 is likewise connected, in a closed circuit, to a compressor 20 and to another U-shaped line 21, the latter being buried in a hole 22.

A fluid of the "Freon" type flows within the closed circuits 15-17-18 and 16-20-21.

The circuit 15-17-18 works as a heat pump which takes calories from the earth of the hole 19 and gives them up inside the hole 8.

The circuit 16-20-21 takes likewise calories from the earth of the hole 22, and gives them up inside the hole 8.

Of course, the number and power of the additional circuits such as 15-17-18 ou 16-20-21 may be any whatever, depending on the de-icing power required in the hole 8.

On the other hand, automatic electric switches may control the electric motors of the compressors 1, 17, 20 and the fan 4, so as to operate same intermittently, depending on the temperature measured at all times in the atmosphere to be conditioned.

Figure 4:
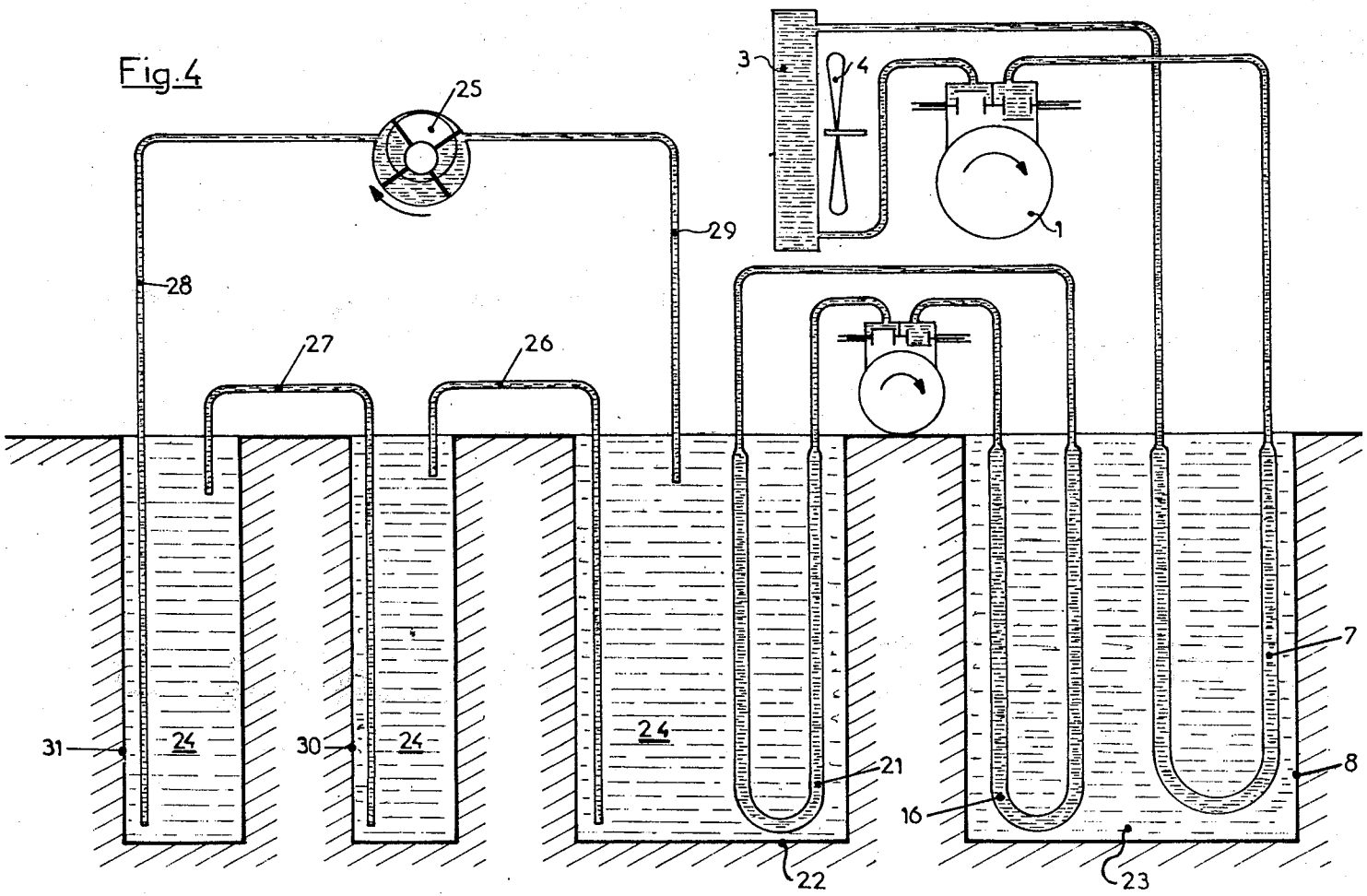
FIGS. 4 and 5 illustrate two other possible modified embodiments.

In the modified embodiment shown in FIG. 4, a further U-shaped line 16 of the above-mentioned kind is disposed in the hole 8, next to the U-shaped line 7. Moreover, the hole 8 is filled up with an anti-freeze liquid 23, under which the lines 7 and 16 lie.

Here again the line 16 is connected, in a closed circuit, to a further U-shaped line 21 which is buried in a hole 22. But said hole 22 is filled with an anti-freeze liquid 24, the circulation of which in a closed circuit is ensured by a circulating device 25. To this end, lines 26, 27, 28, 29 ensure the connection between three holes, 22, 30, and 31, bored in the earth and interconnected in succession. The anti-freeze liquid 24 is thus delivered into the line 28 by the circulating device 25, starts warming up when in contact with the earth in the hole 31, flows up again through the line 27 which leads it into the hole 30, wherein it becomes fully warmed up, flows out of said hole through the line 26, and reaches the hole 22, wherein it cools down while ensuring the de-freezing of the line 21. Then, said liquid 24 flows back to the circulating device 25, and a new cycle starts.

Of course, the number of auxiliary holes such as 22, 30, 31 may vary, depending on the de-freezing power required.

Figure 5:
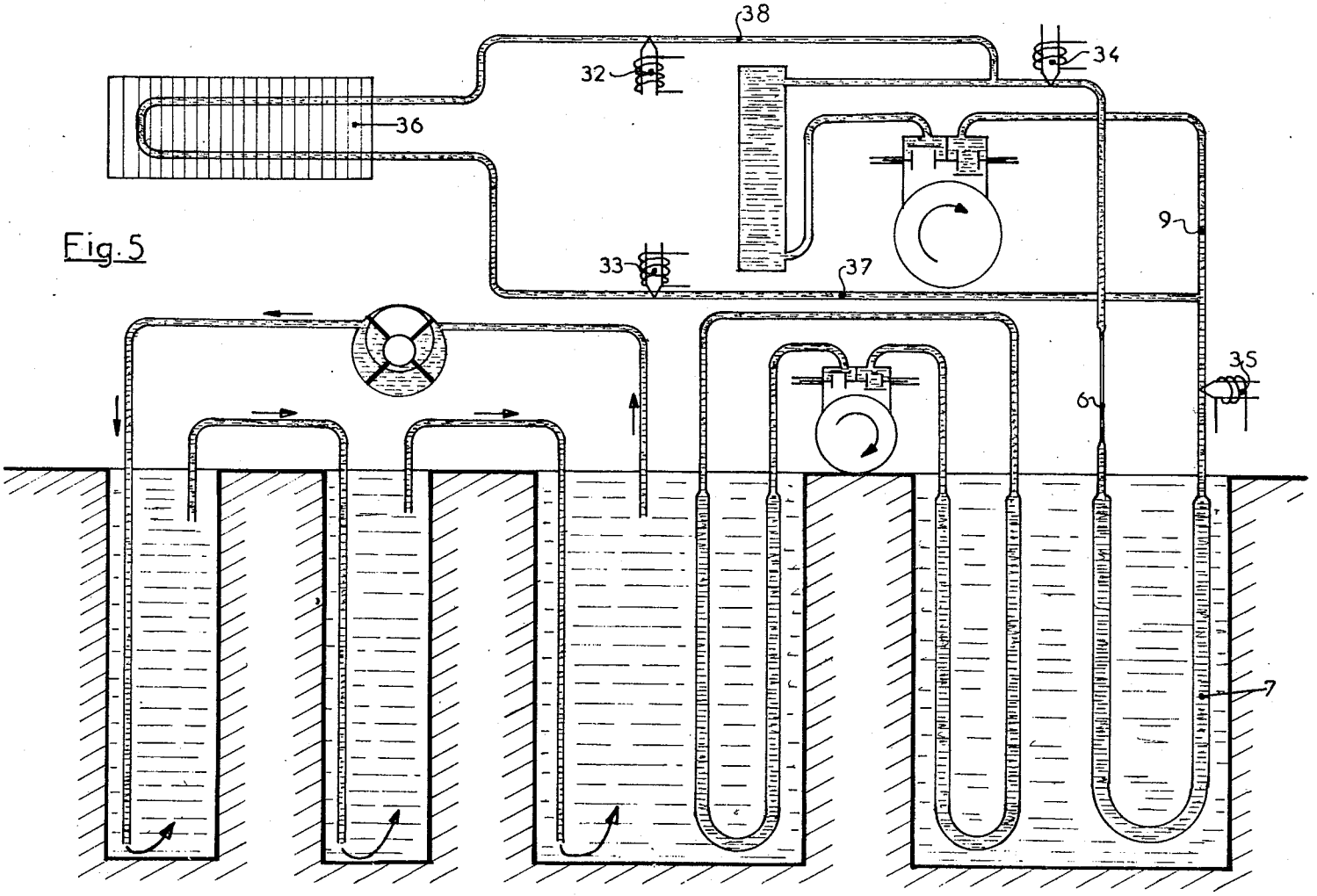

In the modified embodiment illustrated in FIG. 5, the construction of the system is the same as in the embodiment of FIG. 4, but with the addition of an evaporator 36 connected on the fluid circuit, across the line 7. Said evaporator 36 is disposed in the atmosphere of the premises to be conditioned.

Four electro-valves 32, 33, 34 and 35, are interposed in the fluid circuit, to wit:

an electro-valve 32 on the line 38 connecting the evaporator 36 to the capillary tubulure 6, an electro-valve 33 on the line 37 connecting the evaporator 36 to the return line 9, an electro-valve 34 between the line 38 and the capillary tubulure 6, in series with the latter, an electro-valve 35 on the line 9, between the U-shaped pipe 7 and the connection of the line 37.

The de-freezing of the pipe 7 is ensured by the circuits when the apparatus works as a heating system, in the same way as in the embodiment shown in FIG. 4.

If the walls of the evaporator 36 tend to ice up while the temperature of the surrounding atmosphere is higher, then a thermostatic control ensures the opening of the valves 34 and 35, and the closing of the valves 32 and 34 to cut off the evaporator 36 automatically. The circulation takes place thus inside the buried pipe 7, and then, as soon as the evaporator 36 is de-iced, the reverse switching takes place, and the valves 32 and 34 open, while the valves 34 and 35 close again.

Figure 6:
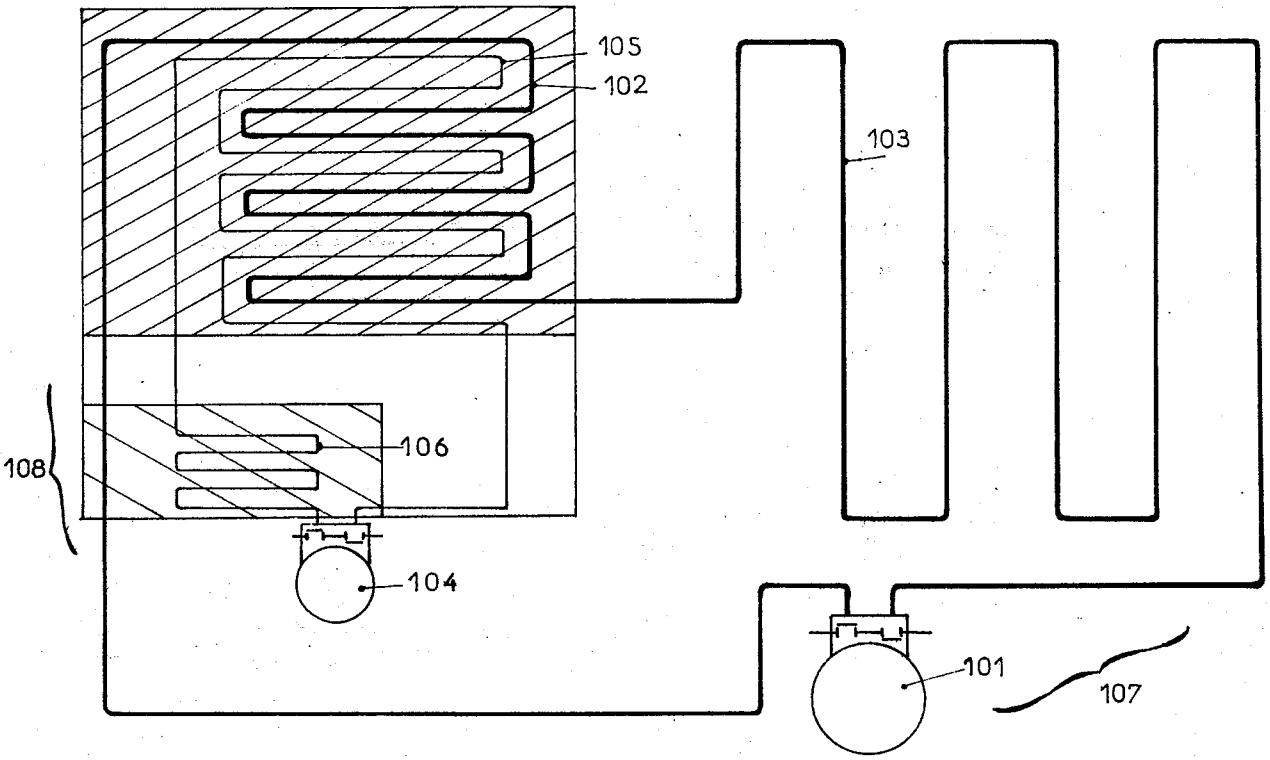
FIG. 6 shows a cold room provided with a de-icing system for the evaporator.

FIG. 6 is a detailed view of the frigorific circuits of refrigeration and de-freezing for a cold room refrigerated by means of the main circuit 107, which includes a compressor 101, an evaporator 102, and a condenser 103. The evaporator alone is disposed in the cold room.

Said evaporator 102 is de-iced by means of an auxiliary frigorific circuit 108, which includes a compressor 104, a condenser 105, and an evaporator 106. The condenser 105 and the evaporator 106 are disposed in the cold room. The condenser 105 is positioned in said room so as to warm up the main evaporator 102. The evaporator 106 is disposed at a location more or less away from the main evaporator 102.

A control device (not shown), allows starting the auxiliary circuit 108 as soon as the main evaporator 102 begins to ice up. The auxiliary evaporator 106 takes then calories from its adjacent surroundings, which calories are given back by the auxiliary condenser 105 to its surroundings. Since said condenser 105 is disposed close to the main evaporator 102, the latter is warmed up by said calories and is thus de-iced.

For its part, the auxliary evaporator 106 has no time for icing up since the auxiliary circuit is only used for very short periods of time.

This system offers an outstanding advantage, in that it allows de-icing a refrigeration circuit without introducing calories into the room to be refrigerated. The latter may be, for instance, a conventional refrigerator.

Consequently, it will be seen that the device according to the invention works both as a heating system and as a refrigerating system with a minimum consumption of electric current. Moreover, the de-icing of the evaporator disposed in the premises to be air-conditioned is always provided for, whether the premises are to be warmed up (FIG. 5) or refrigerated (FIG. 6).

Obviously, it would be possible, without falling out of the scope of the invention, to replace the anti-freeze liquid by a solid body having good heat-conductivity properties and ensuring a satisfactory heat exchange between the circulating fluids.

We claim:

1. An air-conditioning device constituted by a heat pump working between the atmosphere of a room or vat to be air-conditioned and the interior of a first hole bored in the ground, characterized in that said heat pump comprises the following members, which are inserted in a first closed circuit wherein a fluid circulates in its liquid state and its gaseous state:

a. a compressor (1) which receives the fluid as a cold gas, and delivers it as a hot gas;

b. a two position reversing valve (2) connected to said first closed circuit such that it reverses the flow of gas through the circuit as it moves from a first to a second position to allow the device to function either as a heating system or a refrigerating system;

c. an exchanger, (3) connected to said first closed circuit into which the gaseous fluid flows at a certain temperature and out of which it flows at a different temperature, said exchanger being thermally steeped in the atmosphere of the room to be air-conditioned;

d. a capillary tube (6), wherein the fluid circulates to pass from its liquid state to its gaseous state, or conversely;

e. a first U-shaped line or pipe (7) housed inside a first deep hole (8) bored in the earth, and inside which the fluid flows at a certain temperature, circulates and flows out at a temperature substantially equal to that which prevails in said hole; and f. a second closed circuit (15, 17, 18) having a second U-shaped pipe (15) disposed in said first deep hole (8) adjacent said first U-shaped pipe (7), a third U-shaped pipe (18) disposed within a second deep hole (19) and means to pump a fluid (17) through said second closed circuit so as to transfer heat from said first deep hole to said second deep hole and vice versa.

2. A device according to claim 1 characterized in that it works as a heating system, that is:

the compressor (1) delivers hot gas to the exchanger-condenser (3);

said gas enters the exchanger-condenser (3) as a hot gas (at a temperature ranging, for instance from 40°C to 80°C), and flows out of said exchanger-condenser as a cold gas (at a temperature ranging, for instance, from 20° to 30°C);

after leaving the condenser, the gas flows through the capillary tube (6), and flows out of the latter in its liquid state, at a temperature of, for instance, about −20°C;

the liquid flows into the line (7) which is buried in the earth in said first deep hole (8), is gasified to start with, and flows out of the ground at a substantially constant temperature, such as, for instance, 8°–10°C, before being sent back to the inlet side of the compressor.

3. A device according to claim 1 characterized in that it works as a refrigerating system, that is, the compressor delivers hot gas (at a temperature ranging from 40° to 80°C) into the line (7);

said gas cools down in the earth in said first deep hole (8), then expands, and is liquified at about −20°C before leaving the hole;

the liquid evaporates and warms up inside a capillary tube (6), so that it reaches the exchanger (3) at a temperature of about 10°C;

the liquid flows through the exchanger, wherein it warms up, then leaves it, and is directed towards the inlet of the compressor.

4. An air-conditioning device according to claim 1, characterized in that all the holes bored in the ground are filled with an anti-freeze liquid (23, 24).

5. An air-conditioning device according to claim 1 characterized in that it includes two auxiliary heat pumps, to wit:

a first auxiliary heat pump, wherein the circulation of a fluid in a closed circuit is controlled by a circulating device between two U-shaped lines which are buried, the one in the first hole containing already the first U-shaped line, and the other in a second separate hole;

a second auxiliary heat pump, wherein the circulation of a fluid in a closed circuit is controlled by a circulating device between two U-shaped lines which are buried, the one in the first hole, and the other in a third separate hole.

6. A device according to claim 1 characterized in that it includes an evaporator (36) disposed in the surrounding atmosphere, and connected in parallel to the first closed circuit of fluid, via the first U-shaped line (7), while automatically operated thermostatic valves (32, 33, 34, 35) ensure:

cutting off the atmospheric evaporator as soon as the latter begins to ice up, and connecting the first U-shaped line;

cutting off the first U-shaped line and starting the atmospheric evaporator during the whole period of time for which the latter is not iced up.

7. An air-conditioning device according to claim 1, characterized in that it is constituted by a main frigorific circuit (107) which includes a main evaporator (102) disposed in the room, to be refrigerated, while a secondary frigorific circuit (108) includes in a conventional way a condenser (105), an evaporator (106) and a compressor (104), the condenser (105) and the evaporator (106) being disposed in the room, with the condenser (105) close to the main evaporator (102) so as to warm it up, while the secondary evaporator (106) is disposed far enough from the main evaporator (102) so as not to cool down the latter, means being provided to start the secondary circuit (108) automatically when the main evaporator (106) tends to ice up, the refrigeration being thus achieved without introducing any calories taken outside the cold room.

* * * * *